US009893463B1

(12) United States Patent
Cui et al.

(10) Patent No.: US 9,893,463 B1
(45) Date of Patent: Feb. 13, 2018

(54) CONNECTOR OF PROCESS FIELDBUS DECENTRALIZED PERIPHERALS

(71) Applicant: SINBON ELECTRONICS COMPANY LTD., New Taipei (TW)

(72) Inventors: Yong Cui, New Taipei (TW); An Li, New Taipei (TW); Jianbin Tong, New Taipei (TW); Jian Zuo, New Taipei (TW)

(73) Assignee: SINBON ELECTRONICS COMPANY LTD., New Taipei (TW)

( * ) Notice: Subject to any disclaimer, the term of this patent is extended or adjusted under 35 U.S.C. 154(b) by 0 days.

(21) Appl. No.: 15/457,513

(22) Filed: Mar. 13, 2017

(30) Foreign Application Priority Data

Dec. 5, 2016 (CN) ..... 2016 2 1325299

(51) Int. Cl.

| | |
|---|---|
| ***H01R 12/00*** | (2006.01) |
| ***H01R 13/58*** | (2006.01) |
| ***H01R 13/6581*** | (2011.01) |
| ***H01R 13/66*** | (2006.01) |
| ***H01R 4/02*** | (2006.01) |

(52) U.S. Cl.
CPC ..... *H01R 13/5845* (2013.01); *H01R 4/023* (2013.01); *H01R 13/6581* (2013.01); *H01R 13/665* (2013.01)

(58) Field of Classification Search
CPC ..... H01R 13/6658; H01R 2201/26; H01R 9/097; H01R 13/745; H01R 25/003; H01R 9/0518; H01R 31/06; H01R 12/57
USPC ..... 439/76.1, 76.2, 75, 565, 654, 585, 439/620.01, 638, 876
See application file for complete search history.

(56) References Cited

U.S. PATENT DOCUMENTS

| | | | | |
|---|---|---|---|---|
| 4,236,779 | A * | 12/1980 | Tang | H01R 13/6592 439/580 |
| 6,752,855 | B2 * | 6/2004 | Marumo | B01D 19/0052 204/237 |
| 7,604,501 | B2 * | 10/2009 | Rosch | H01R 9/032 439/607.01 |
| 2015/0180185 | A1 * | 6/2015 | Shammoh | H01R 13/70 439/373 |

* cited by examiner

*Primary Examiner* — Phuong Chi T Nguyen
(74) *Attorney, Agent, or Firm* — Rabin & Berdo, P.C.

(57) ABSTRACT

A connector of a process field bus decentralized peripherals has a circuit board, two communicating cables each having two core wires and a shielding net layer, the two core wires coated by the shielding net layer, ends of the two core wires electrically connected to the circuit board, an inner shell mounted on the ends of the core wires by injection molding, a shielding layer covering the inner shell and the circuit board, the shielding layer electrically connected to the shielding net layers, and an outer shell mounted on the shielding layer by injection molding. Since the inner shell and the outer shell are formed by injection molding, the circuit board is tightly fixed in the connector. Further, the shielding layer is mounted between the inner shell and the outer shell to protect the circuit board from electromagnetic interference. Therefore, quality of the connector may be improved.

19 Claims, 17 Drawing Sheets

CONNECTOR OF PROCESS FIELDBUS DECENTRALIZED PERIPHERALS

CROSS-REFERENCE TO RELATED APPLICATIONS

This application claims the priority benefit of CN application serial No. 201621325299.9, filed on Dec. 5, 2016. The entirety of the above-mentioned patent applications is hereby incorporated by reference herein and made a part of specification.

BACKGROUND OF THE INVENTION

1. Field of the Invention

The present invention relates to a connector, and particularly to a connector of a process field bus decentralized peripherals (PROFIBUS-DP).

2. Description of the Related Art

A process Fieldbus (PROFIBUS) is a common technique in Fieldbus. The PROFIBUS comprises a technique of process field bus decentralized peripherals (PROFIBUS-DP) and a technique of process field bus process automation (PROFIBUS-PA).

Performance of the PROFIBUS-DP and the PROFIBUS-PA are better than performance of other kinds of PROFIBUS. The PROFIBUS is adapted to automation systems and communication between fieldbus signal units. The PROFIBUS may connect to a connector of a transmitter, an actuator, a transmission device, a fieldbus meter, or a fieldbus equipment, to sample and monitor fieldbus signals.

The PROFIBUS may replace common transmission cables by a pair of twisted pair wires. Therefore, construction cost of cables may be decreased, and time and cost of adjustment during construction may also be decreased. Further, maintenance time and cost may be decreased when a PROFIBUS system is operating.

With reference to FIG. 16, a topology of the PROFIBUS comprises a PROFIBUS master 161, multiple PROFIBUS slaves 162, and a PROFIBUS repeater 163. The PROFIBUS master 161 connects to the PROFIBUS slaves 162 through connectors and cables of the PROFIBUS. The PROFIBUS master 161 may connect to the PROFIBUS repeater 163 through the connectors and cables, and may further connect to other PROFIBUS slaves 162 through the PROFIBUS repeater 163. Then, a network of the PROFIBUS may be further expanded.

The PROFIBUS master 161 may cyclically read messages from the PROFIBUS slaves 162 through the topology of the PROFIBUS, and may transmit messages to the PROFIBUS slaves 162 through the topology of the PROFIBUS.

With reference to FIG. 17, the connector 170 of the PROFIBUS comprises a circuit board 171, a connecting port 172, and a plastic shell 173. The circuit board 171 and the connecting port 172 are mounted in the plastic shell 173. The plastic shell 173 is consisted of two half shells. Since one terminal of one of the two half shells is pivotally connected with one terminal of another of the two half shells, the plastic shell 173 is a flip shell. When the plastic shell 173 is covered, the circuit board 171 and the connecting port 172 are mounted inside the plastic shell 173, and the connecting port 172 extends through the plastic shell 173 to connect to the PROFIBUS master 161, the PROFIBUS slaves 162, or the PROFIBUS repeater 163. Two connectors 170 are connected together through the cable 174, and two terminals of the cable 174 are respectively inserted into ends of the two connectors 170.

However, as the circuit board 171 and the connecting port 172 are just mounted in the plastic shell 173, the circuit board 171 and the connecting port 172 may not be tightly covered by the plastic shell 173. The circuit board 171 and the connecting port 172 may be loosened, and the loosened circuit board 171 and the connecting port 172 may be disconnected from the cable 174. Therefore, quality of the connector 170 may not be good.

Besides, since the plastic shell 173 may not shield the circuit board 171 from electromagnetic interference, a metallic shield 175 is mounted between the circuit board 171 and the plastic shell 173 to cover the circuit board 171, and the metallic shield 175 may be further electrically connected with a shielding net layer of the cable 174. Therefore, the metallic shield 175 may shield the circuit board 171 from electromagnetic interference.

However, since the metallic shield 175 may not totally cover the circuit board 171, the connector 170 may not completely protect the circuit board 171 from the electromagnetic interference. Therefore, the connector 170 needs to be improved.

SUMMARY OF THE INVENTION

An objective of the present invention is to provide a connector of a process field bus decentralized peripherals (PROFIBUS-DP). The connector may protect a circuit board inside the connector from electromagnetic interference.

To achieve the foregoing objective, the connector comprises a circuit board, two communicating cables, an inner shell, a shielding layer, and an outer shell.

At least one connecting port is adapted to be mounted on the circuit board.

The two communicating cables each comprise two core wires and a shielding net layer. The two core wires are coated by the shielding net layer, such that the shielding net layer covers the two core wires. Ends of the two core wires are electrically connected to the circuit board.

The inner shell is mounted on the ends of the core wires by injection molding to cover the ends of the core wires of the two communicating cables.

The shielding layer covers the inner shell and the circuit board, and is electrically connected to the shielding net layers of the two communicating cables.

The outer shell is mounted on the shielding layer by injection molding to cover the shielding layer, and the at least one connecting port extends through the inner shell, the shielding layer, and the outer shell.

Since the inner shell and the outer shell are formed by injection molding, the circuit board may be tightly fixed in the connector. Therefore, quality of the connector may be improved. Further, since the shielding layer is mounted between the inner shell and the outer shell and the shielding layer is electrically connected to the shielding net layers of the two communicating cables, the circuit board may be completely protected from electromagnetic interference.

Other objectives, advantages and novel features of the invention will become more apparent from the following detailed description when taken in conjunction with the accompanying drawings.

DETAILED DESCRIPTION OF THE INVENTION

Figure 1:
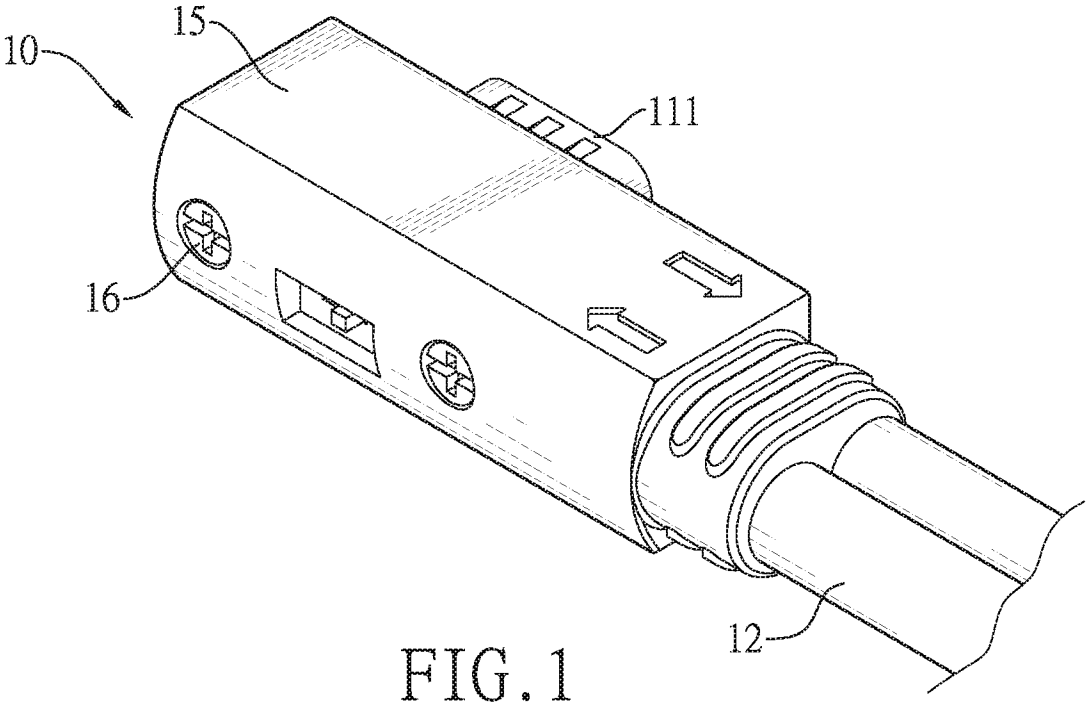
FIG. 1 is a perspective view of a first embodiment of a connector of a PROFIBUS-DP of the present invention.
Figure 2:
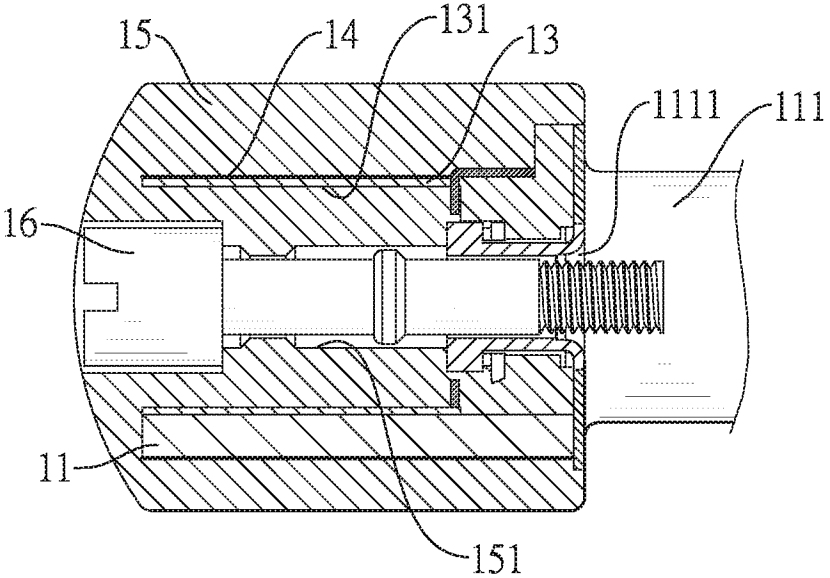
FIG. 2 is a cross sectional view of the first embodiment of the connector of the PROFIBUS-DP of FIG. 1.
Figure 3:
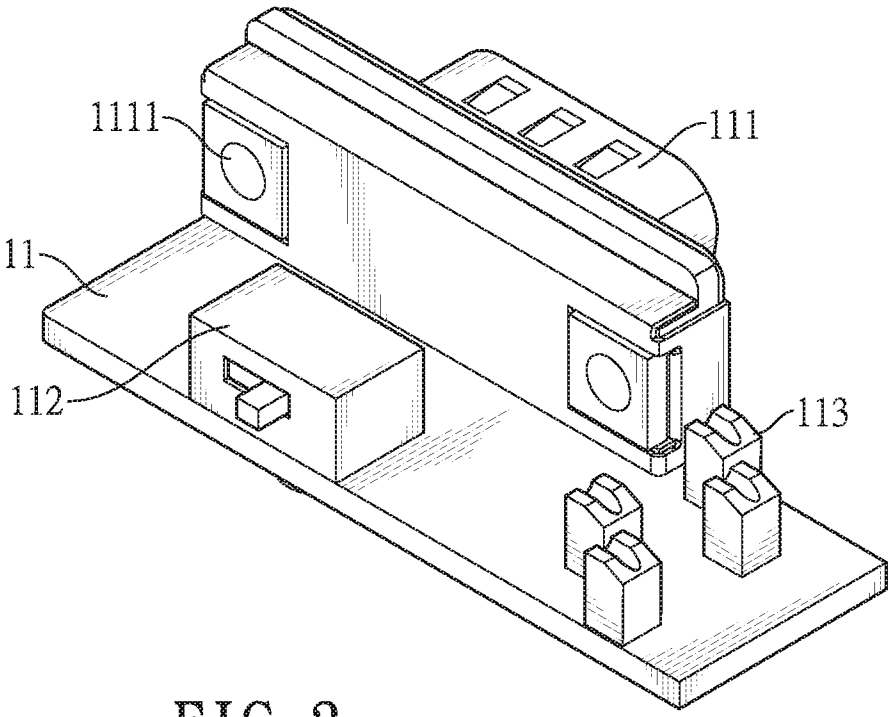
FIGS. 3-7 are schematic views showing manufacturing flows of the first embodiment of the connector of the PROFIBUS-DP of FIG. 1.

With reference to FIGS. 1 and 2, the present invention is a connector 10 of a PROFIBUS-DP. The connector 10 of the PROFIBUS-DP comprises a circuit board 11, two communicating cables 12, an inner shell 13, a shielding layer 14, and an outer shell 15.

Figure 4:
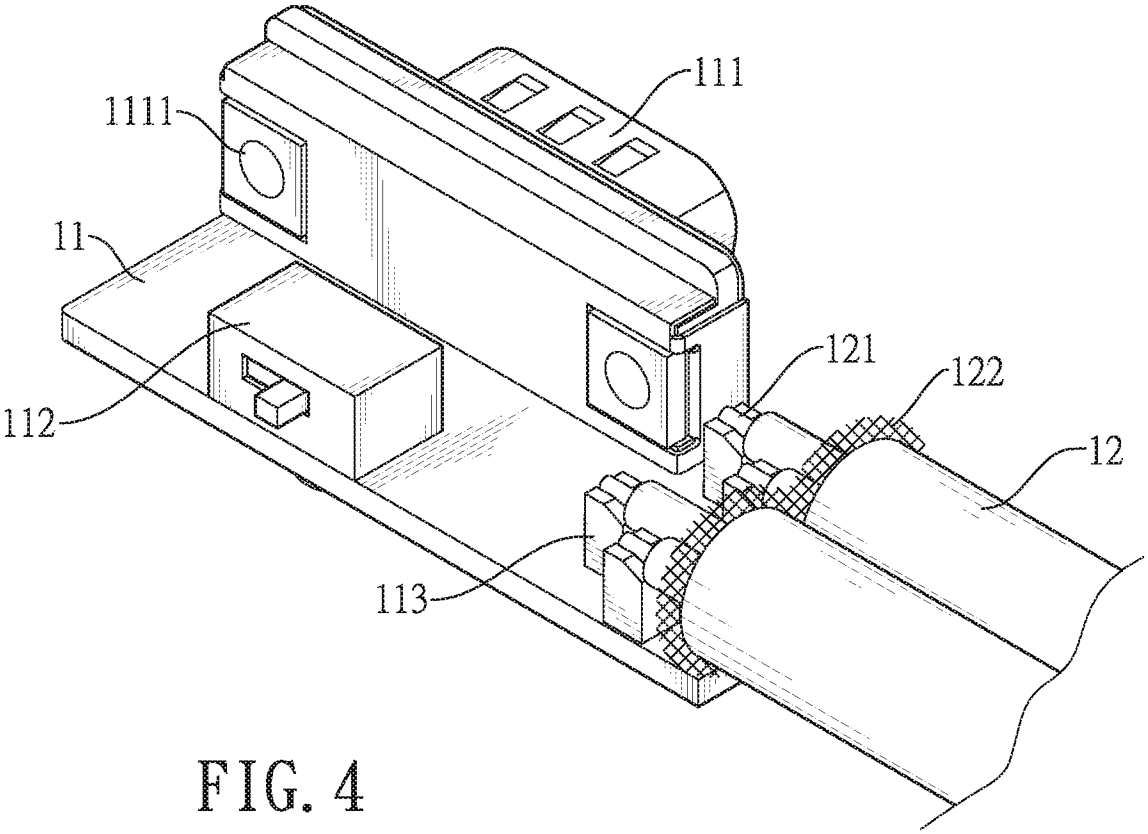

With reference to FIG. 4, at least one connecting port 111 is adapted to be mounted on the circuit board 11. In a first embodiment, one connecting port 111 is mounted on the circuit board 11. Each one of the two communicating cables 12 comprises two core wires 121 and a shielding net layer 122. The two core wires 121 are coated by the shielding net layer 122, such that the shielding net layer 122 covers the two core wires 121. End of the two core wires 121 is electrically connected to the circuit board 11.

The inner shell 13 is mounted on the ends of the core wires 121 by injection molding to cover the ends of the core wires 121 of the two communicating cables 12. The shielding layer 14 totally covers the inner shell 13 and the circuit board 11, and is electrically connected to the shielding net layers 122 of the two communicating cables 12.

The outer shell 15 is mounted on the shielding layer 14 by injection molding to cover the shielding layer 14. The connecting port 111 extends through the inner shell 13, the shielding layer 14, and the outer shell 15.

Since the inner shell 13 and the outer shell 15 are manufactured by injection molding, the circuit board 11 may be tightly fixed in the connector 10 of the PROFIBUS-DP. Therefore, quality of the connector 10 may be improved. Further, since the shielding layer 14 is mounted between the inner shell 13 and the outer shell 15 and is electrically connected to the shielding net layers 122 of the two communicating cables 12, the circuit board 11 may be completely protected from electromagnetic interference. Therefore, capability of shielding electromagnetic interference of the connector 10 of the PROFIBUS-DP may be increased.

With reference to FIGS. 3 to 7, a manufacture method of the first embodiment of the connector 10 of the PROFIBUS-DP is shown. As disclosed in FIG. 3, the circuit board 11 is provided. A connecting port 111, a switch 112, multiple conductive bars 113, and any other necessary elements (not shown in the figures) are mounted on the circuit board 11. The connecting port 111 is mounted on an end of the circuit board 11.

As disclosed in FIG. 4, the ends of the two core wires 121 of the two communicating cables 12 may be welded on the conductive bars 113 of the circuit board 11.

Figure 5:
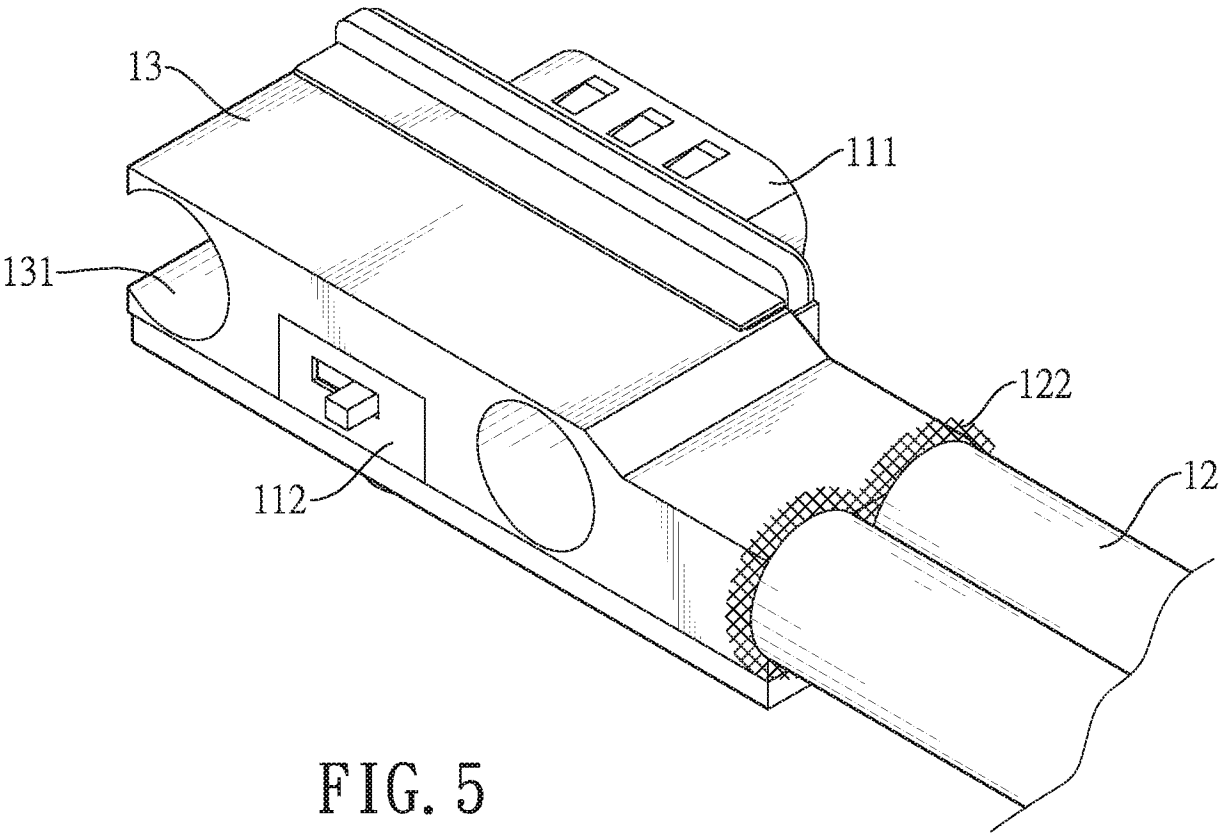

As disclosed in FIG. 5, the inner shell 13 is mounted on the circuit board 11 by injection molding to cover the circuit board 11 and the ends of the two core wires 121 of the two communicating cables 12. Further, the inner shell 13 may cover the switch 112, the conductive bars 113, and any other necessary elements mounted on the circuit board 11. In the first embodiment, the connecting port 111 further comprises two first through holes 1111, and the inner shell 13 further comprises two second through holes 131. The two second through holes 131 of the inner shell 13 respectively communicate with the two first through holes 1111 of the connecting port 111. The connecting port 111 of the circuit board 11 extends through the inner shell 13. The switch 112 controls usage status of the circuit board 11.

Figure 6:
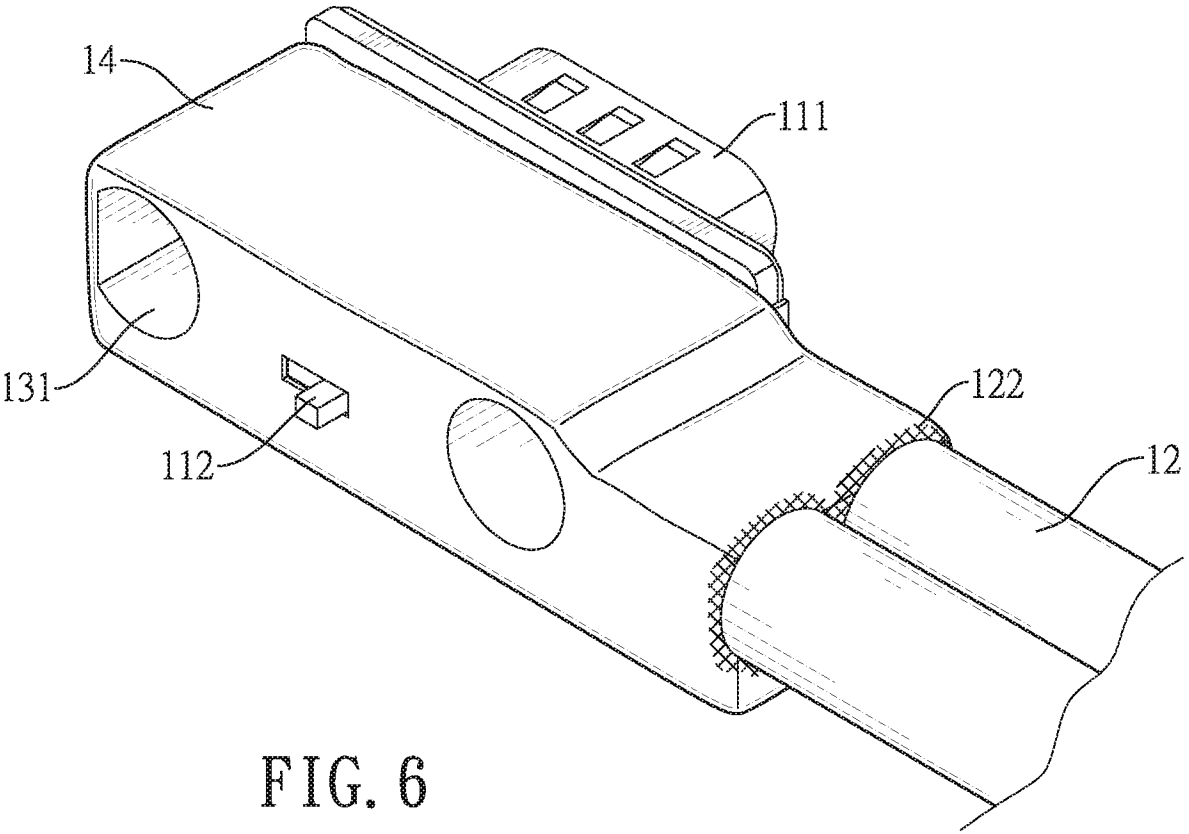

As disclosed in FIG. 6, the shielding layer 14 covers the inner shell 13 and the circuit board 11. The shielding layer 14 is welded on the shielding net layer 122 of the two core wires 121 to be electrically connected to the shielding net layer 122. In the first embodiment, the shielding layer 14 is a copper foil shielding tape, and the connecting port 111 of the circuit board 11 extends through the shielding layer 14.

Figure 7:
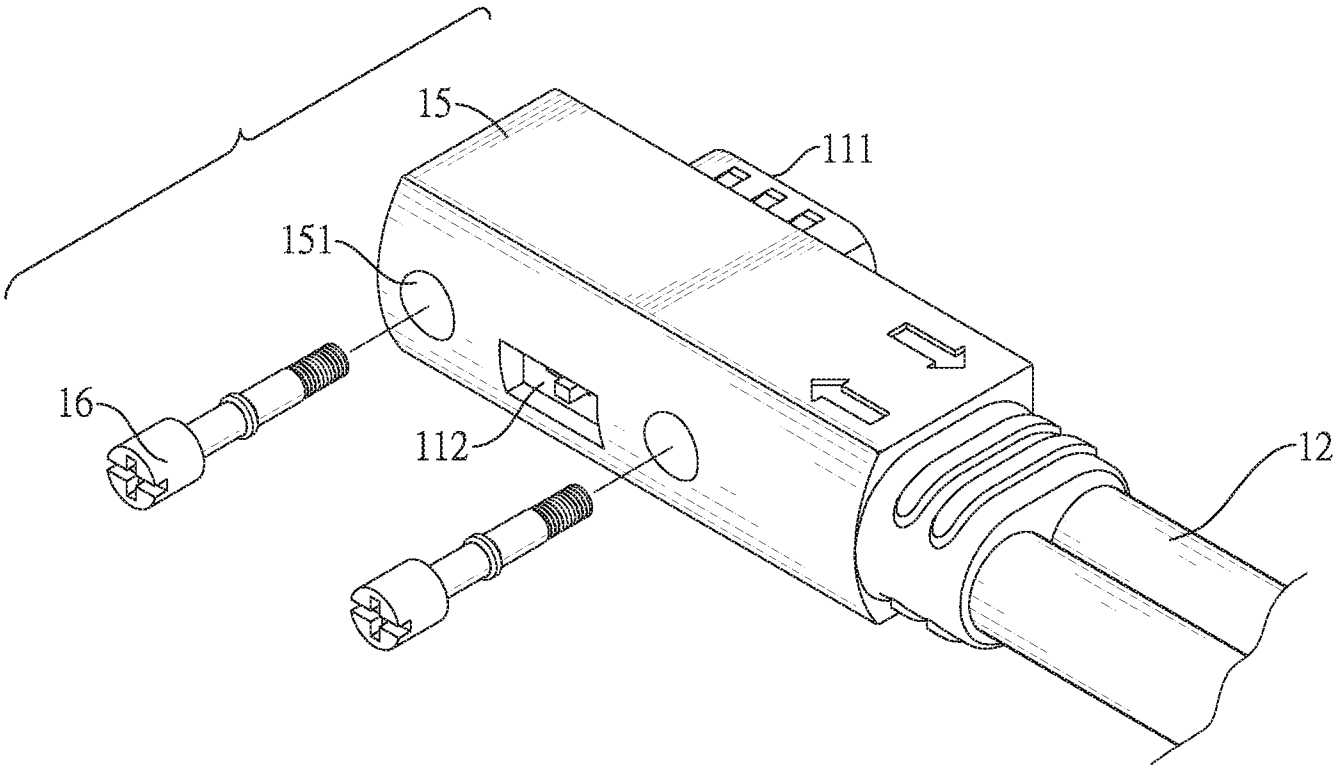

As disclosed in FIG. 7, the outer shell 15 is mounted on the shielding layer 14 by injection molding to cover the shielding layer 14, and the connecting port 111 of the circuit board 11 extends through the outer shell 15. In the first embodiment, the outer shell 15 further comprises two third through holes 151. The two third through holes 151 of the outer shell 15 are respectively formed through the two second through holes 131 of the inner shell 13. The two third through holes 151 of the outer shell 15 respectively communicate with the two first through holes 1111 of the connecting port 111.

The connector 10 of the PROFIBUS-DP further comprises two fastening elements 16. The two fastening elements 16 are respectively mounted through the two third through holes 151 and the two first through holes 1111 to pass through the outer shell 15, the inner shell 13, and the connecting port 111. Therefore, when the connector 10 of the PROFIBUS-DP is connected to a PROFIBUS device (not shown), such as a PROFIBUS master, a PROFIBUS slave, or a PROFIBUS repeater, the connecting port 111 may be connected to a connector port of the PROFIBUS device. Further, the two fastening elements 16 may be screwed into the PROFIBUS device through the two third through holes 151 and the two first through holes 1111, and the connector 10 may be firmly fixed on the PROFIBUS device.

Figure 8:
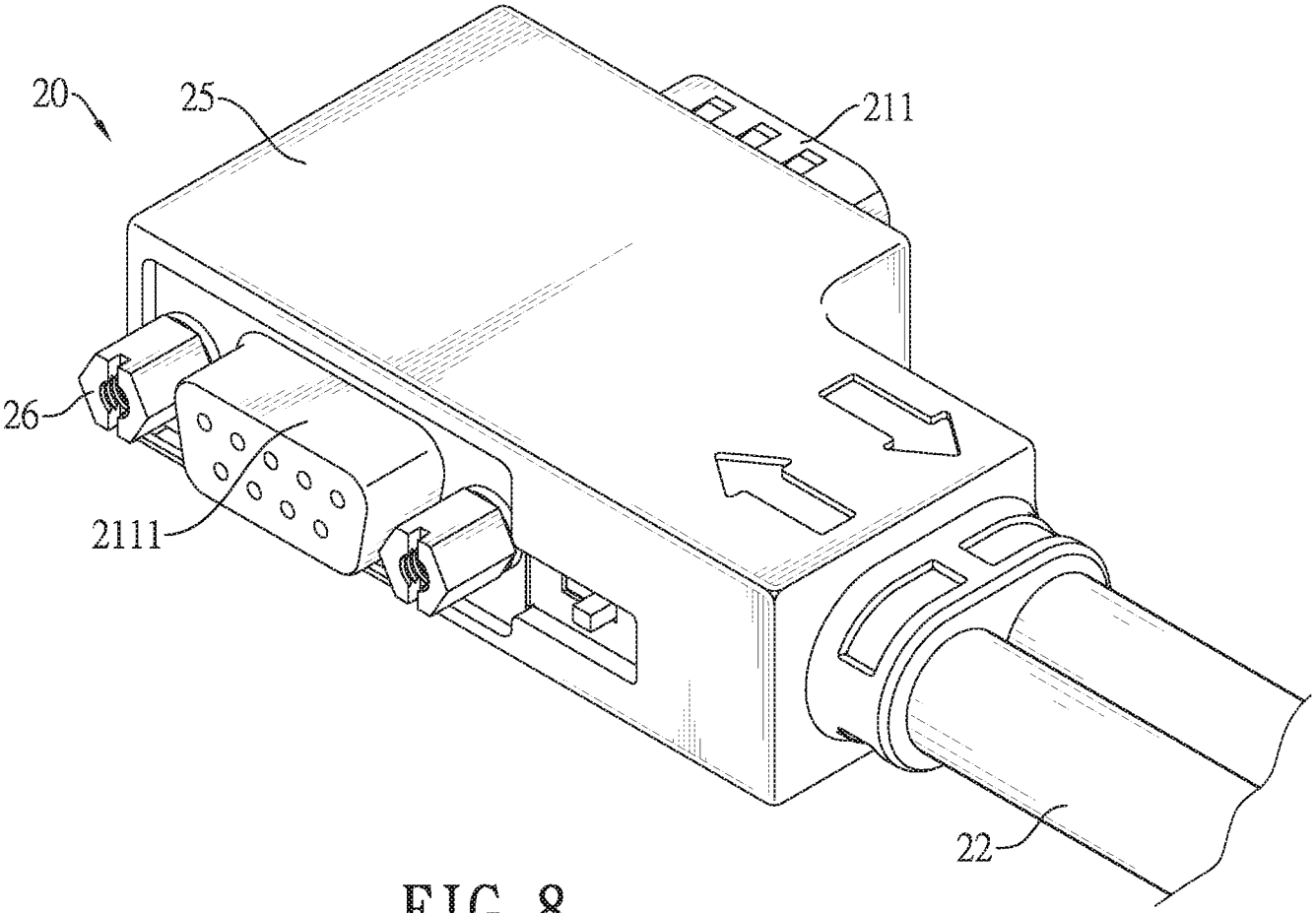
FIG. 8 is a perspective view of a second embodiment of a connector of a PROFIBUS-DP.
Figure 9:
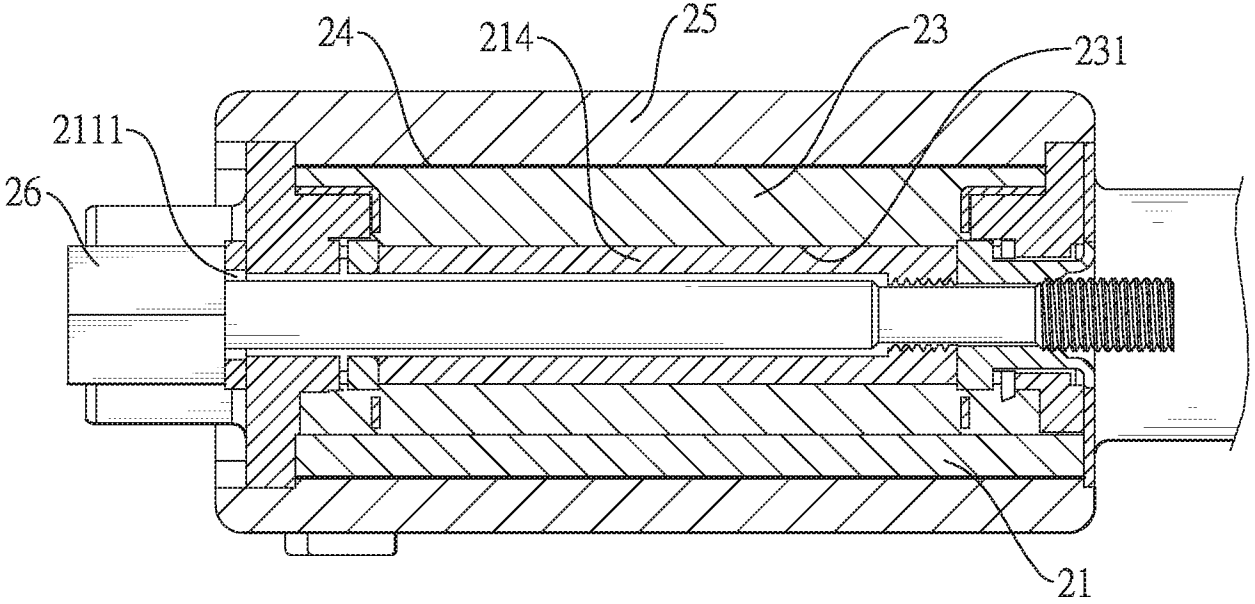
FIG. 9 is a cross sectional view of the second embodiment of the connector of the PROFIBUS-DP of FIG. 8.
Figure 10:
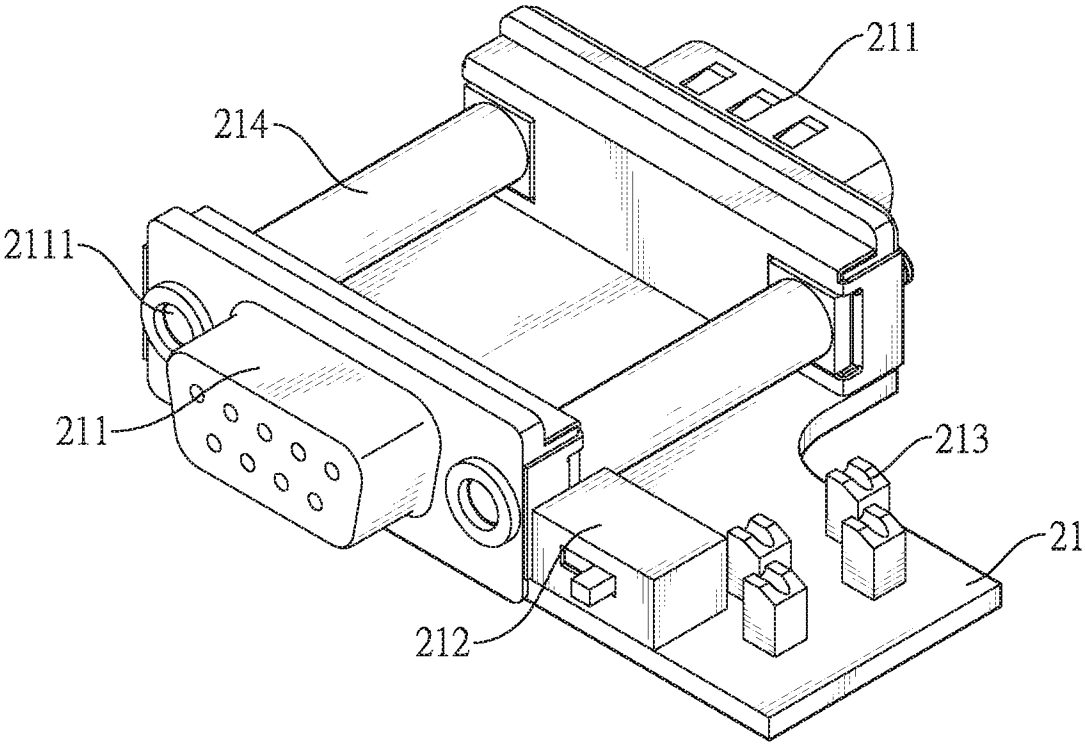
FIGS. 10-14 are schematic views to manufacture the second embodiment of the connector of the PROFIBUS-DP of FIG. 8.

With reference to FIGS. 8 and 9, a second embodiment of the connector 20 of the PROFIBUS-DP comprises a circuit board 21, two communicating cables 22, an inner shell 23, a shielding layer 24, and an outer shell 25.

Figure 11:
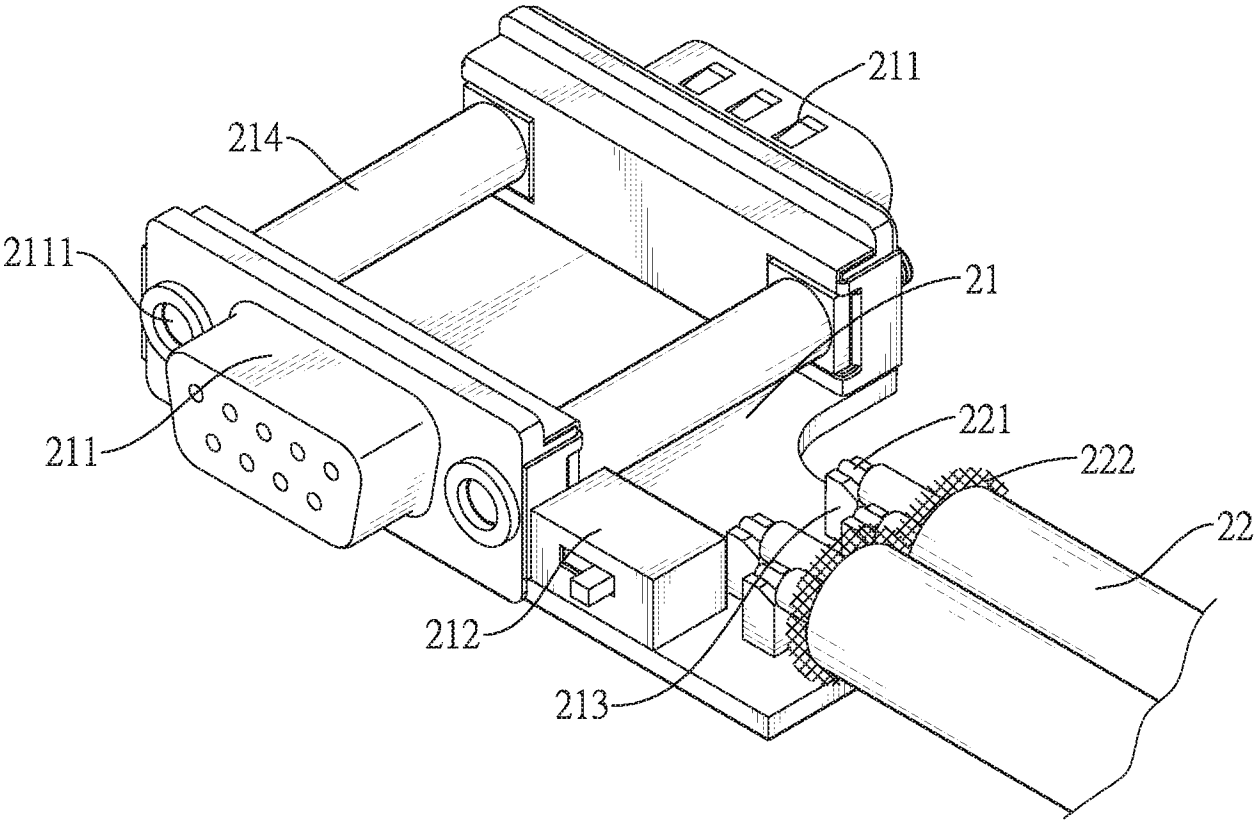

With reference to FIG. 11, at least one connecting port 211 is adapted to be mounted on the circuit board 21. In the second embodiment, two connecting ports 211 are mounted on the circuit board 21, and the two connecting ports 211 are respectively mounted on two opposite ends of the circuit board 21. Each of the two communicating cables 22 comprises two core wires 221 and a shielding net layer 222. The two core wires 221 are coated by the shielding net layer 222, such that the shielding net layer 222 covers the two core wires 221. Ends of the two core wires 221 are electrically connected to the circuit board 21.

The inner shell 23 is mounted on the ends of the core wires 221 by injection molding to cover the ends of the core wires 221 of the two communicating cables 22. The shielding layer 24 covers the inner shell 23 and the circuit board 21, and is electrically connected to the shielding net layers 222 of the two communicating cables 22.

The outer shell 25 is mounted on the shielding layer 24 by injection molding to cover the shielding layer 24. The two connecting ports 211 extend through the inner shell 23, the shielding layer 24, and the outer shell 25.

A difference between the first embodiment and the second embodiment is that the second embodiment of the connector 20 comprises two connecting ports 211. One of the two connecting ports 211 may be connected to the connecting port of the PROFIBUS-DP device, and the other one of the two connecting ports 211 may be connected to another connector 20 or another connecting port of other PROFIBUS-DP device. Therefore, a topology of the PROFIBUS may be more easily constructed.

With reference to FIGS. 10 to 14, a manufacture method of the second embodiment of the connector 20 of the PROFIBUS-DP is shown. As disclosed in FIG. 10, the circuit board 21 is provided. Two connecting ports 211, a switch 212, multiple conductive bars 213, two connecting tubes 214, and any other necessary elements (not shown in the figures) are mounted on the circuit board 21. The two connecting ports 211 are respectively mounted on two opposite ends of the circuit board 21, and each of the two connecting ports 211 comprises two first through holes 2111. The two connecting tubes 214 are mounted between the two connecting ports 211, and two of the first through holes 2111 that are of the two different connecting ports 211 communicate with each other through one of the two connecting tubes 214. As disclosed in FIG. 9, the inner shell 23 comprises two second through holes 231, and the two connecting tubes 214 are respectively mounted in the two second through holes 231 of the inner shell 23.

As disclosed in FIG. 11, the ends of the two core wires 221 of the two communicating cables 22 may be welded on the conductive bars 213 of the circuit board 21.

Figure 12:
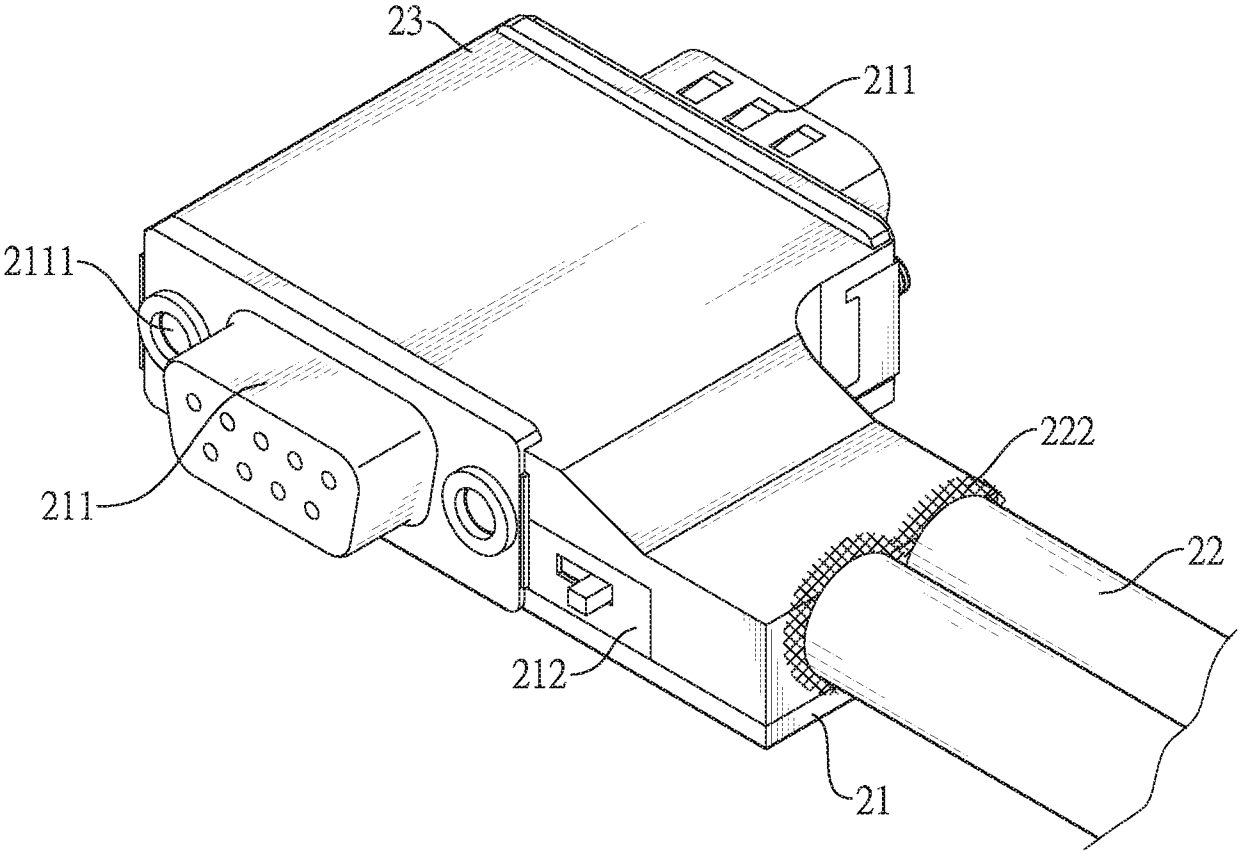

As disclosed in FIG. 12, the inner shell 23 is mounted on the ends of the core wires 221 by injection molding to cover the circuit board 21 and the ends of the two core wires 221 of the two communicating cables 22, and further to cover the switch 212, the conductive bars 213, the two connecting tubes 214, and any other necessary elements mounted on the circuit board 21. In the second embodiment, the two connecting ports 211 of the circuit board 21 are respectively extended through the inner shell 23. The switch 212 controls usage status of the circuit board 21.

Figure 13:
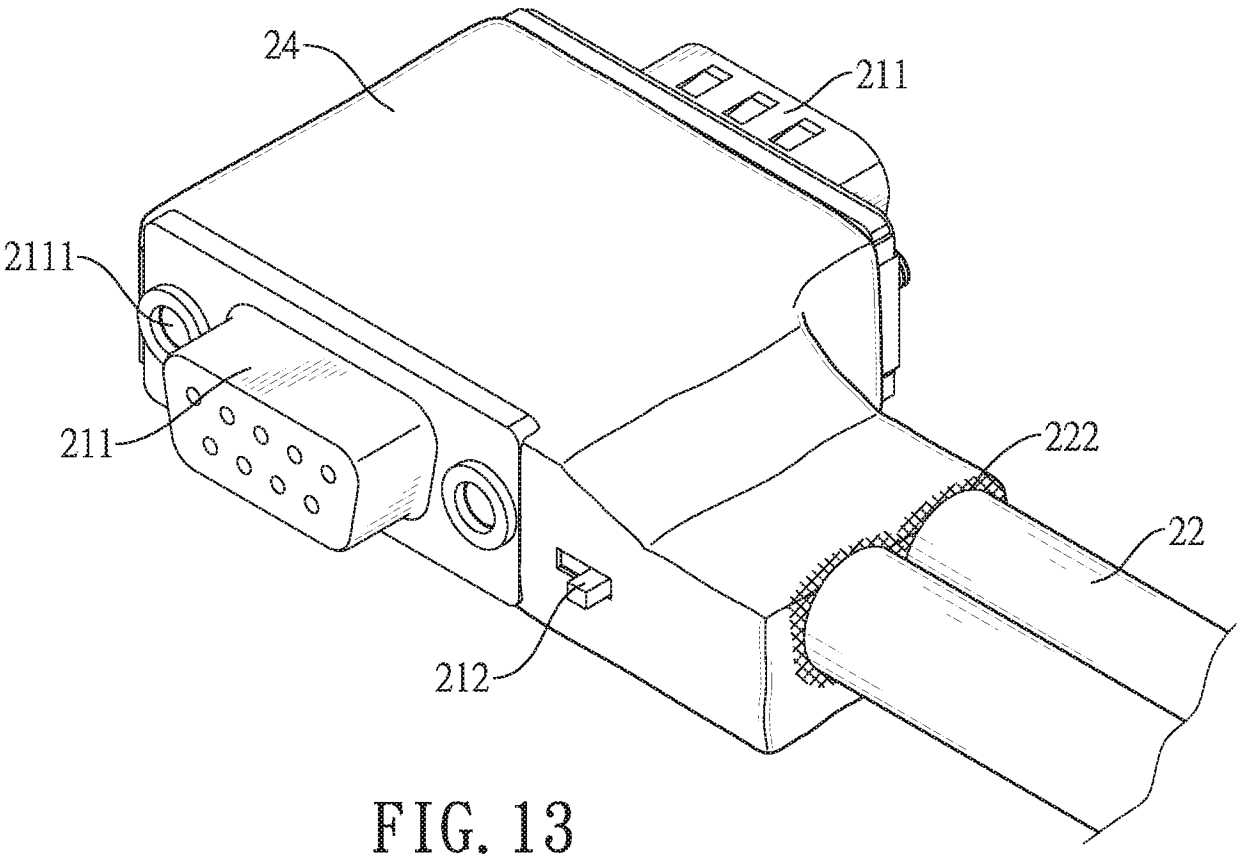

As disclosed in FIG. 13, the shielding layer 24 covers the inner shell 23 and the circuit board 21, and the shielding layer 24 is welded on the shielding net layer 222 of the two core wires 221 to be electrically connected to the shielding net layer 222. In the second embodiment, the shielding layer 24 is a copper foil shielding tape, and the two connecting ports 211 of the circuit board 21 extend through the shielding layer 24.

Figure 14:
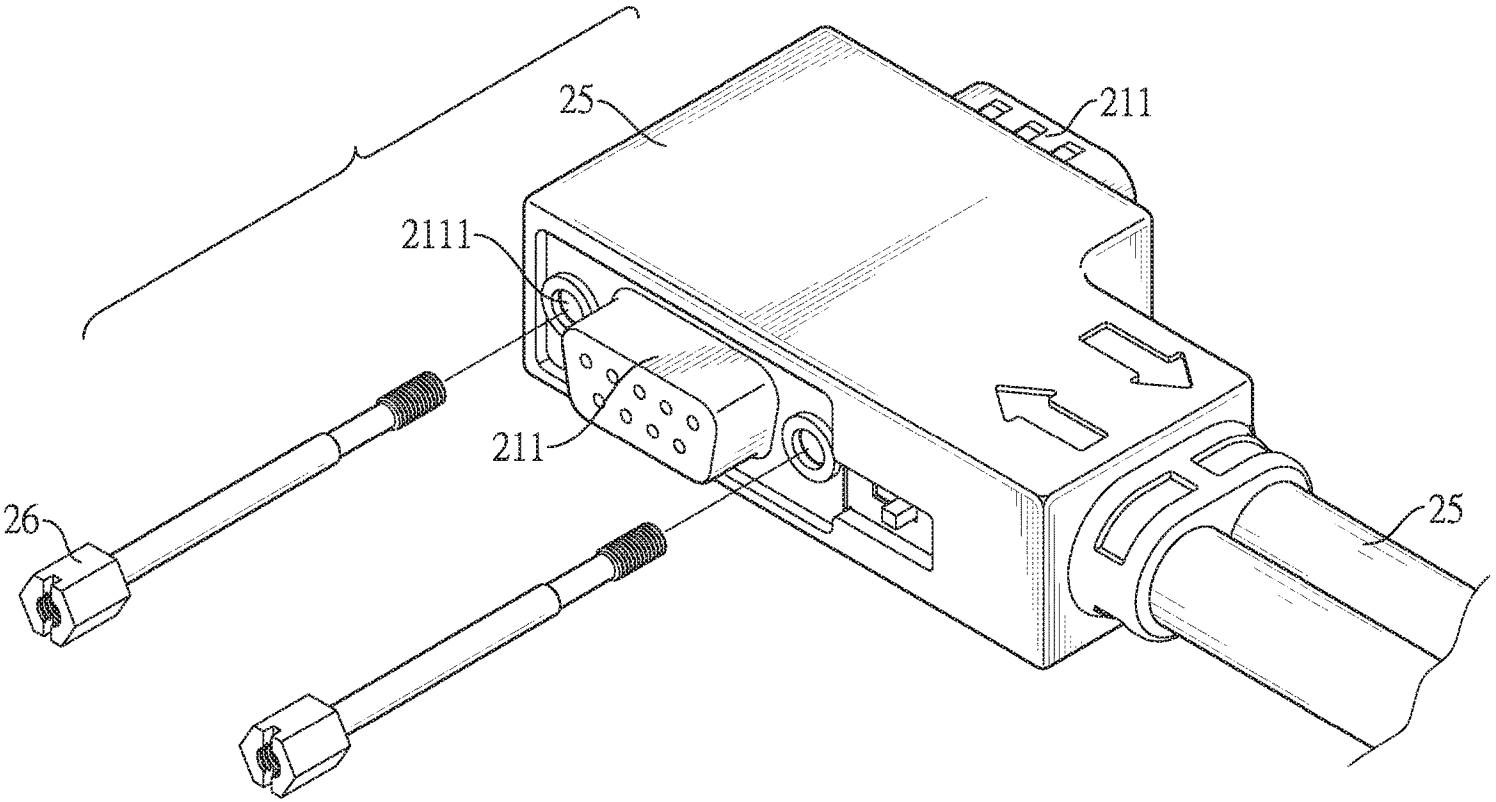

As disclosed in FIG. 14, the outer shell 25 is mounted on the shielding layer 24 by injection molding to cover the shielding layer 24, and each of the two connecting ports 211 of the circuit board 21 extends through the outer shell 25. In the second embodiment, the connector 20 of the PROFIBUS-DP further comprises two fastening elements 26. The two fastening elements 26 are respectively mounted through the first through holes 2111 of the connecting ports 211 and the two connecting tubes 214 to pass through the two connecting ports 211, the outer shell 25, and the inner shell 23. Therefore, when the connector 20 is connected to a PROFIBUS device (not shown), such as a PROFIBUS master, a PROFIBUS slave, or a PROFIBUS repeater, one of the two connecting ports 211 may be connected to a connector port of the PROFIBUS device. Further, the two fastening elements 26 may be screwed into the PROFIBUS device, and the connector 20 may be firmly fixed on the PROFIBUS device.

Figure 15:
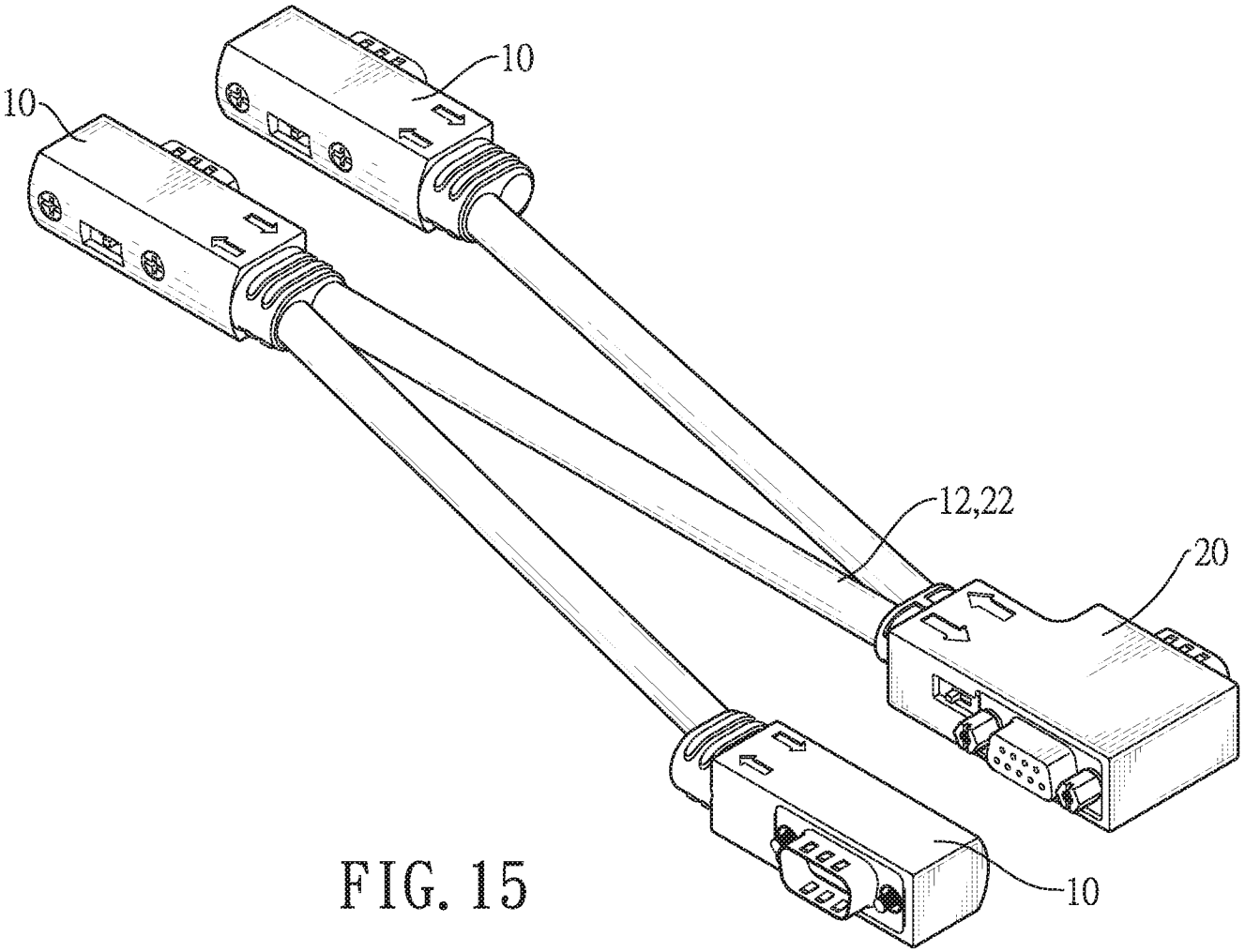
FIG. 15 is a schematic view showing the connectors of the PROFIBUS-DP of FIGS. 1 and 8.
Figure 16:
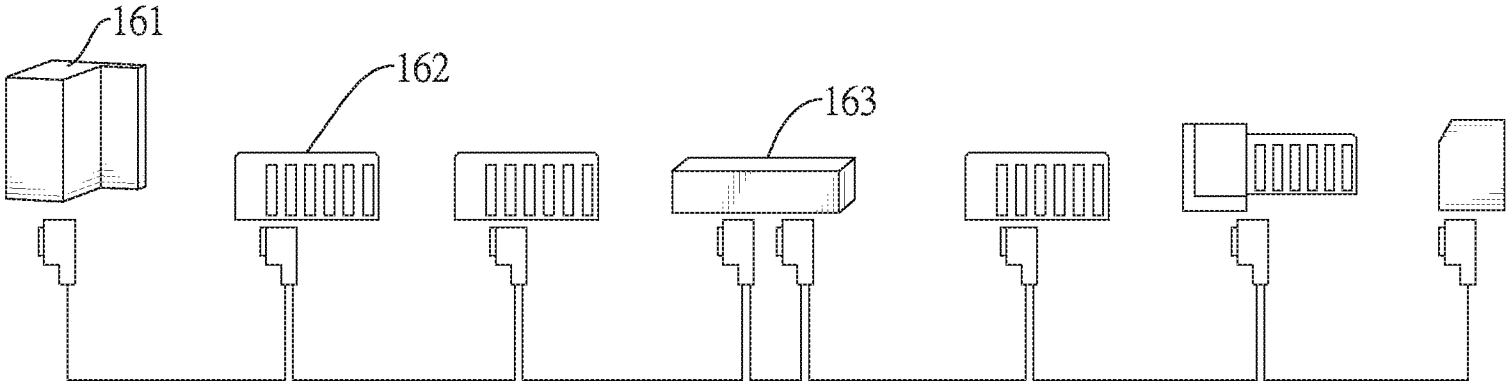
FIG. 16 PRIOR ART
FIG. 16 is a schematic view of a conventional topology of a PROFIBUS.
Figure 17:
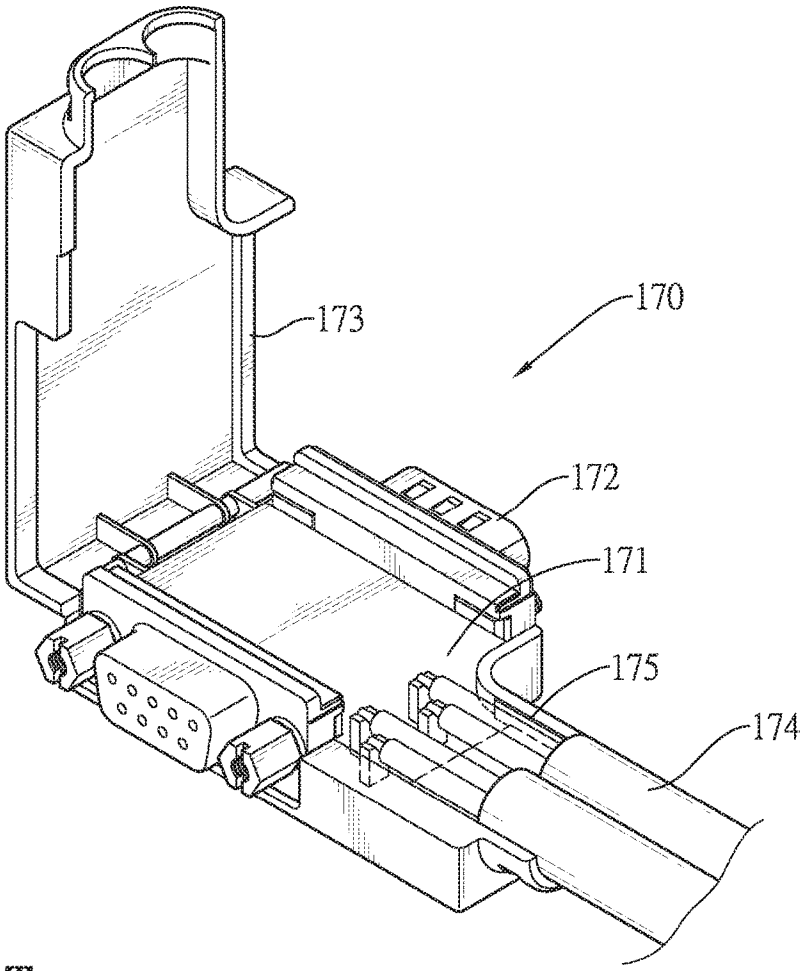
FIG. 17 PRIOR ART
FIG. 17 is a perspective view of a conventional connector of a PROFIBUS.

With reference to FIG. 15, the first embodiment of the connector 10 and the second embodiment of the connector 20 may be connected through the two communicating cables 12, 22. The first embodiment of the connector 10 and the second embodiment of the connector 20 may be respectively connected to two PROFIBUS devices. Therefore, the two PROFIBUS devices may communicate with each other to transmit data, and then, the topology of the PROFIBUS may be constructed.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A connector of a process field bus decentralized peripherals, comprising:

a circuit board; wherein at least one connecting port is adapted to be mounted on the circuit board;

two communicating cables; wherein each one of the two communicating cables comprises:

a shielding net layer; and two core wires, coated by the shielding net layer; wherein ends of the two core wires are electrically connected to the circuit board;

an inner shell, mounted on the ends of the core wires by injection molding to cover the ends of the core wires of the two communicating cables;

a shielding layer, totally covering the inner shell and the circuit board, and electrically connected to the shielding net layers of the two communicating cables; and an outer shell, mounted on the shielding layer by injection molding to cover the shielding layer; wherein the at least one connecting port extends through the inner shell, the shielding layer, and the outer shell;

wherein the at least one connecting port further comprises two first through holes;

wherein the inner shell further comprises two second through holes; and wherein the two second through holes of the inner shell respectively communicate with the two first through holes of the connecting port.

2. The connector as claimed in claim 1, wherein:

a switch is mounted on the circuit board;

the switch is covered by the inner shell, and controls usage status of the circuit board.

3. The connector as claimed in claim 1, wherein:

the at least one connecting port is implemented as two connecting ports in amount and the two connecting ports are mounted on two opposite ends of the circuit board;

each of the two connecting ports comprises the two first through holes;

two connecting tubes are mounted on the circuit board and between the two connecting ports, and the two connecting tubes are respectively mounted in the two second through holes of the inner shell; and two of the first through holes that are of the two different connecting ports communicate with each other through one of the two connecting tubes.

4. The connector as claimed in claim 3, further comprising two fastening elements respectively mounted through the first through holes of the connecting ports and the two connecting tubes to pass through the two connecting ports, the outer shell, and the inner shell.

5. The connector as claimed in claim 1, wherein:

the at least one connecting port is implemented as one connecting port in amount and is mounted on an end of the circuit board.

6. The connector as claimed in claim 5, wherein:

the outer shell further comprises two third through holes;

the two third through holes of the outer shell are respectively formed through the two second through holes of the inner shell; and the two third through holes of the outer shell respectively communicate with the two first through holes of the connecting port.

7. The connector as claimed in claim 6, further comprising two fastening elements respectively mounted through the two third through holes to pass through the outer shell and the inner shell.

8. The connector as claimed in claim 1, wherein:

the shielding layer is a copper foil shielding tape.

9. The connector as claimed in claim 8, wherein:

the at least one connecting port is implemented as one connecting port in amount and is mounted on an end of the circuit board.

10. The connector as claimed in claim 8, wherein:

the at least one connecting port is implemented as two connecting ports in amount and the two connecting ports are mounted on two opposite ends of the circuit board.

11. The connector as claimed in claim 10, wherein:

each of the two connecting ports comprises two first through holes;

two connecting tubes are mounted on the circuit board and between the two connecting ports; and two of the first through holes that are of the two different connecting ports communicate with each other through one of the two connecting tubes.

12. The connector as claimed in claim 11, further comprising two fastening elements respectively mounted through the first through holes of the connecting ports and the two connecting tubes to pass through the two connecting ports, the outer shell, and the inner shell.

13. The connector as claimed in claim 1, wherein:

multiple conductive bars are mounted on the circuit board;

the ends of the two core wires of the two communicating cables are welded on the conductive bars of the circuit board.

14. The connector as claimed in claim 13, wherein:

the at least one connecting port is implemented as one connecting port in amount and is mounted on an end of the circuit board.

15. The connector as claimed in claim 14, wherein:

the outer shell further comprises two third through holes;

the two third through holes of the outer shell are respectively formed through the two second through holes of the inner shell; and the two third through holes of the outer shell respectively communicate with the two first through holes of the connecting port.

16. The connector as claimed in claim 15, further comprising two fastening elements respectively mounted through the two third through holes and the two first through holes to pass through the outer shell, the inner shell, and the connecting port.

17. The connector as claimed in claim 13, wherein:

the at least one connecting port is implemented as two connecting ports in amount and the two connecting ports are mounted on two opposite ends of the circuit board.

18. The connector as claimed in claim 17, wherein:

each of the two connecting ports comprises two first through holes;

two connecting tubes are mounted on the circuit board and between the two connecting ports; and two of the first through holes that are of the two different connecting ports communicate with each other through one of the two connecting tubes.

19. The connector as claimed in claim 18, further comprising two fastening elements respectively mounted through the first through holes of the connecting ports and the two connecting tubes to pass through the two connecting ports, the outer shell, and the inner shell.

* * * * *